United States Patent [19]

Everson

[11] Patent Number: 4,805,964

[45] Date of Patent: Feb. 21, 1989

[54] METHOD OF MAKING A TRACK BROOM BRISTLE

[75] Inventor: Richard W. Everson, Salisbury, N.C.

[73] Assignee: Thermoid, Inc., Bellefontaine, Ohio

[21] Appl. No.: 156,773

[22] Filed: Feb. 16, 1988

Related U.S. Application Data

[62] Division of Ser. No. 890,241, Jul. 28, 1986.

[51] Int. Cl.[4] ..... A46B 7/10; A46B 13/02

[52] U.S. Cl. ..... 300/21; 29/417; 15/186; 15/159 A; 15/179

[58] Field of Search ..... 300/21; 29/411, 417; 15/159 A, 186, 187, 188; 51/334

[56] References Cited

U.S. PATENT DOCUMENTS 4,184,223 1/1980 Price ..... 300/21 X 4,484,373 11/1984 Price ..... 300/21 X

*Primary Examiner*—Timothy V. Eley

*Attorney, Agent, or Firm*—Kirkpatrick & Lockhart

[57] ABSTRACT

A sweeper bristle element especially adapted for the use in a broom machine for a railway road bed or track. The sweeper bristle elements of the broom machine have a solid rubber core and layers of rubber coated fabric encircling the solid rubber core. The fabric in the rubber coated layers provide sufficient strength to resist breakage during cleaning and also provides sufficient flexibility to improve the wear of the bristle elements. The fabric is spiral wound with a thin layer of nylon material and then cured to form an integral and compact bristle element. The nylon material is then unwrapped and the bristle element is cut into a plurality of small length bristle elements.

3 Claims, 1 Drawing Sheet

FIG. 1
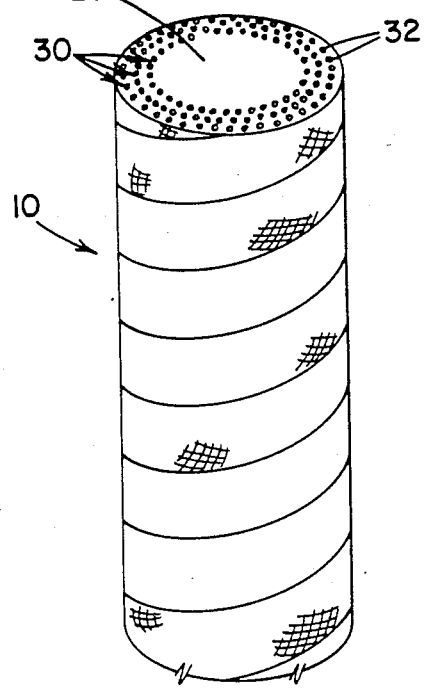
FIG. 2
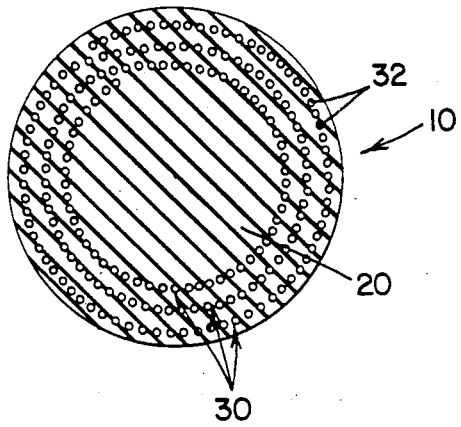
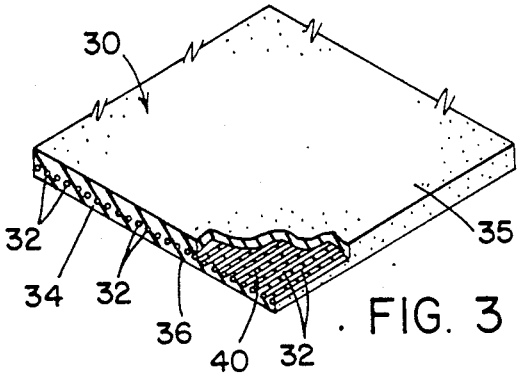
FIG. 3
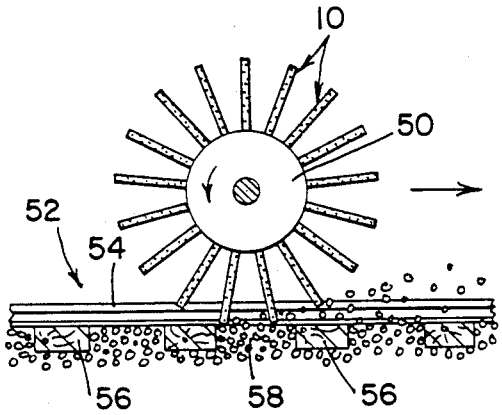
FIG. 4

METHOD OF MAKING A TRACK BROOM BRISTLE

This is a divisional of co-pending application Ser. No. 890,241 filed on July 28, 1986.

BACKGROUND OF THE INVENTION

This invention relates to a track broom bristle for use on a broom machine adapted for maintenance work on a railway road bed.

Such broom machines are used for dressing the surface of ballast of the bed between and along the sides of the rails, generally termed the ballast bed, and for leveling and distributing ballast over the bed. Such broom machine employs a plurality of broom bristle elements in combination with a rotating drum and element support for use on a broom machine.

Railway ballast generally comprises a thick layer of crushed limestone or similar material resting on a prepared base, in which track cross ties are embedded and supported. The ballast bed is shaped to have a generally horizontal top face over the length of the ties, that is, between the rails and alongside the rails and to have sloped banks at and beyond the ends of the ties. Desirably, the top surface of the ballast is level with or slightly below the top faces of the ties, and the ties and rails should be free of loose ballast and other debris.

Both in maintenance and original construction of the road bed, new ballast is dumped onto the road bed from rail cars and is roughly distributed by a blade device, such as a plow or mold board. However, it is not possible for such a blade device to produce the desired finished condition in which the ballast is level with or slightly below the tops of the ties. A broom machine with a sweeper bristle element can produce the desired distribution of the ballast. The sweeping of ballast, however, imposes a severe load on a sweeper bristle element so that such elements are subject to heavy wear and generally a short life.

Various types of bristle elements have been previously used, for example, such as bristle elements constructed of links of steel cable encased in rubber are removably fastened to a mandrel or drum of the broom machine. The rubber cover is used to control fraying of the cable. With such a bristle element it was found that in ballast dressing operations, such steel cable bristles would last only for a short period of time before requiring replacement. Further, such bristles require significant replacement time.

In other instances, a bristle element is replaceably mounted on a mandrel rotatable on a horizontal axis. These bristle elements have cores made of a bundle of parallel straight steel splines or wires fixed together at one end in a detachable coupling and encased in a resilient sheath which binds the splines into mutually supporting relation and distributes flexing stress in them away from their fixed end. Such a combination is complex to manufacture and expensive to assemble because of the many and various components and the machining necessary to create the structure.

The present invention is directed to a bristle element that is easier and more economical to manufacture and relatively easy to assemble wherein the bristle has suitable wear life and can be easily mounted on a rotating drum.

SUMMARY OF THE INVENTION

It is an object of the present invention to provide a bristle element which has superior durability, possessing desirable flexible properties, and easily manufactured.

The bristle element of the present invention is made of a solid one-piece elastomeric core that has at least one layer of a rubber coated fabric encircling the core and formed integral therewith.

BRIEF DESCRIPTION OF THE DRAWINGS

FIG. 1 is a perspective view of the sweeper bristle element of the invention wrapped in a nylon jacket, ready for cure;

FIG. 2 is a cross-sectional view of the sweeper bristle element according to the invention;

FIG. 3 is a perspective view of a portion of rubber coated fabric used in the making of a sweeper bristle element; and FIG. 4 is a side view showing the sweeper bristle elements mounted in a horizontally rotating drum located over a railway bed.

DETAILED DESCRIPTION

Referring now to the drawings, wherein like reference numerals designate like or corresponding parts throughout the several views, there is shown in FIGS. 1 and 2, a sweeper bristle element 10 made up of a core 20 and at least one layer of rubber coated fabric 30.

The core 20 is generally made up of a solid elastomeric material, such as rubber, or a composition blend of rubber and plastic which has a durometer range of about 60 to about 70 durometer on a Shore, type A, durometer gauge. One suitable rubber that can be used is styrene butadiene rubber (SBR). The core 20 generally has a circular cross-sectional shape with an outside diameter of about $1\frac{3}{4}''$ (4.4 cm) wherein the outside diameter of the core 20 is dependent on the outside diameter of the bristle element 10 which is generally about $2\frac{1}{8}''$ (5.4 cm) $\pm 1/16''$ (0.16 cm).

Then at least one layer 30 of a rubber coated fabric is wound around the central core 20. The layer or layers 30 is made up of cords 32 that are skim coated with elastomeric material 34 providing a thin coating of rubber on both sides of the layer 30. The cords 32 may be comprised of material such as nylon, polyester, rayon, glass, steel or other typical material that has a tensile strength of between about 800 and about 1500 pounds per square inch (351,550 and 1,054,650 kilograms per square meter) wherein the layer 30 has suitable flexibility. The layer of rubber fabric 30 is positioned such that the cords 32 of the ply lie essentially longitudinally to the length of the core 20 or the central longitudinal axis of the core 20.

It is generally preferred that from one (1) to about five (5) layers of rubber coated fabric 30 be wrapped around the core 20. However, it has been found that when one layer 30 of rubber coated fabric is wrapped around the core 20 there is not sufficient strength to withstand the abrasive sweeping action necessary to perform its function in the bristle broom. Furthermore, it has been found that when more than five (5) layers of rubber coated fabric 30 are wrapped around the core 20, the bristle elements do not have sufficient flexibility to permit them to perform their function efficiently and economically. It is more desirable to use from two (2) to four (4) layers of rubber coated fabric 30 wrapped around the core 20. In FIG. 2, three (3) layers of rubber coated fabric 30 are wrapped around the core 20.

In FIG. 3, a segment of the layer of rubber coated fabric 30 is shown which includes the cords 32 and a skim coating of elastomeric material. The layer 30 is made up of reinforcing cords or strands disposed in a parallel spaced-apart relation which are held in position by picks 40 if desired.

In fabrication of the sweeper bristle element 10, the core 20 of elastomeric material, preferably SBR, is generally formed by extruding a length of the elastomeric material to a predetermined diameter of about 1.75 inch (4.445 centimeters). At least one layer of the rubber coated fabric 30 is wrapped around the core 20 such that the direction of the cords 32 is parallel to the length or the longitudinal axis of the core 20.

The rubber coated layer of fabric 30 is formed when a sheet of fabric or cords 32 of selected width is passed between two rolls with uncured elastomeric coating stock. As the sheet passes between the rolls, the sheet of fabric is coated on both sides with a skim coating of uncured elatomeric material. In the preferred embodiment, one side 35 (which is upper side as viewed in FIG. 3) is coated with more elastomeric material than the other side 36, wherein side 35 becomes the radial outer side of the rubber coated layer 30. Most preferably, side 36 is coated with about $\frac{1}{3}$ of the thickness of rubber and side 35 is coated with about $\frac{2}{3}$ of the thickness of rubber. Thereafter, a thin ply of nylon material is spirally wound around the fabric ply or layer 30 to form an uncured bristle element. The longitudinally extending bristle element is vulcanized and then cooled, unwrapped and cut into desired lengths. Generally, the cured bristle element can be over fifty feet long, permitting the fabrication of a plurality of bristle elements economically. The cured assembly, after unwrapping of the nylon cure tape, can be cut to 18 inch lengths. The nylon tape effectively facilitates the curing process to make the bristle element a compact, integral unit because of its tendency to shrink during cure.

As shown in FIG. 4, the sweeper bristle is mounted to radially project from a rotatable drum 50 by suitable means, such as a clamp, vise, threaded closure, or other similar means well known and employed in the art. In particular, one means of mounting is described in U.S. Pat. No. 4,144,610 wherein a sweeper bristle element 10 is adjustably affixed to a plate with an adjustable clamping device.

The drum 50 is located over a railway bed 52 which includes track 54 and ties 56. Ballast 58 in the form of crushed limestone or other loose material is located between the ties 56 and around the entire railway bed 52.

The sweeper bristle element 10 functions and depends upon the centrifugal force created by rotating the drum 50 at approximately 250 rpm. This fast turning of the drum causes the sweeper bristle 10 to strike the ballast 58 and drive it away from the bristle elements. The result is the flat, even distribution of the ballast along a railway bed 52 which has been cleaned or cleared by a broom machine employing a drum 50 with sweeper bristles 10 according to the invention. Alternatively, the drum 50 may employ slow turning, thereby creating a brushing action of the sweeper bristle 10. This is in contrast with the steel bristles of the prior art which are strictly limited in their function to scraping or raking action of the ballast.

A unique and desirable feature of the sweeper bristle element 10 is its ability to flex in any direction. The sweeper bristle element 10 generally has been found to move aside when striding or brushing a fixed object. This prevents the sweeper bristle element 10 from scraping or digging into the object, such as track 54 or ties 56.

The use of the above sweeper bristle element 10 provides a method of clearing a railway roadbed of loose material, such as ballast 58. The process particularly includes the steps of rotating a plurality of the sweeper bristles 10 over the railway roadbed 52 to be cleared. The rotation is performed such that the ends of the bristles 10 contact the ballast 58. Such rotation imparts a centrifugal force on the sweeper bristle element 10 so that the striking of the loose material by the sweeper bristle element 10 causes the loose material to be driven away from the sweeper bristle element 10.

Although the invention has been described in detail relative to a presently preferred embodiment, it is evident from the description that departures from and modifications to that description can be made within the scope of the invention measured by the scope of the claims.

I claim:

1. The method of making a sweeper bristle element comprising the steps of extruding a longitudinally extending cylindrical core of rubber, wrapping at least one ply of fabric having a plurality of cords coated with rubber, said wrapped ply of fabric having a radial exterior surface and a radial interior surface around said core, spiral winding a ply of nylon material around said ply of fabric to form an uncured bristle element, vulcanizing said bristle element, thence unwrapping said ply of nylon, and cutting said bristle element into a plurality of small length of bristle elements.

2. The method of making, a sweeper bristle element as set forth in claim 1 wherein said wrapped ply of fabric has more rubber on the radial exterior surface of such fabric than on said radial interior surface of ply when placed on said core.

3. The method of making a sweeper bristle element as set forth in claim 2 wherein said wrapping of said ply of fabric includes the wrapping of four plies of fabric around said core.

* * * * *